US012371834B2

(12) United States Patent
Fukumori et al.

(10) Patent No.: US 12,371,834 B2
(45) Date of Patent: Jul. 29, 2025

(54) CHAIN-OFF THREAD CUTTER

(71) Applicant: JUKI CORPORATION, Tama (JP)

(72) Inventors: Eiji Fukumori, Tokyo (JP); Tsuyoshi Hanada, Tokyo (JP); Kazuhiro Mitani, Tokyo (JP); Atsushi Shiraishi, Tokyo (JP)

(73) Assignee: JUKI CORPORATION, Tama (JP)

( * ) Notice: Subject to any disclaimer, the term of this patent is extended or adjusted under 35 U.S.C. 154(b) by 0 days.

(21) Appl. No.: 18/230,279

(22) Filed: Aug. 4, 2023

(65) Prior Publication Data

US 2024/0044062 A1 Feb. 8, 2024

(30) Foreign Application Priority Data

Aug. 4, 2022 (JP) ..... 2022-124504

(51) Int. Cl.
*D05B 65/00* (2006.01)

(52) U.S. Cl.
CPC ..... *D05B 65/00* (2013.01)

(58) Field of Classification Search
CPC ..... D05B 65/00; D05B 65/003; D05B 65/02; D05B 37/04
See application file for complete search history.

(56) References Cited

U.S. PATENT DOCUMENTS 3,598,070 A * 8/1971 Rosenberg ..... D05B 35/102 271/227
3,818,851 A * 6/1974 Marforio ..... D05B 65/00 112/130
3,831,537 A * 8/1974 Siegel ..... D05B 69/10 335/272
4,217,841 A * 8/1980 Daido ..... D05B 69/18 112/277
4,453,481 A * 6/1984 Garnett ..... D05B 65/00 112/288
5,134,947 A * 8/1992 Price ..... D05B 33/02 112/63
5,159,889 A * 11/1992 Price ..... D05B 65/00 112/288
5,303,664 A * 4/1994 Imai ..... D05B 65/00 112/292
6,164,224 A * 12/2000 Tachikawa ..... D05B 3/02 112/300
2004/0055521 A1* 3/2004 Katou ..... D05B 11/00 112/260
2005/0045077 A1* 3/2005 Bober ..... A47B 81/06 108/147
2020/0173079 A1* 6/2020 James ..... D05B 65/00
2020/0308746 A1* 10/2020 Chan ..... D05B 23/007
2022/0042226 A1* 2/2022 Kvarnstrand ..... G06N 3/048

FOREIGN PATENT DOCUMENTS

JP 2019-058232 A 4/2019

* cited by examiner

*Primary Examiner* — Patrick J. Lynch
(74) *Attorney, Agent, or Firm* — Faegre Drinker Biddle & Reath LLP

(57) ABSTRACT

A chain-off thread cutter for cutting a chain-off thread formed by a sewing machine. The chain-off thread cutter including: a fixed blade; a movable blade that moves toward and away from the fixed blade; a driving unit that drives the movable blade to move the movable blade; a foreign matter detector that detects foreign matter present in a track of the movable blade; and a control unit that stops the driving unit when the foreign matter is detected by the foreign matter detector.

6 Claims, 11 Drawing Sheets

CHAIN-OFF THREAD CUTTER

CROSS-REFERENCE TO RELATED APPLICATIONS

The present application claims the benefit of priority of Japanese Patent Application No. 2022-124504, filed on Aug. 4, 2022, the content of which is incorporated herein by reference.

TECHNICAL FIELD

The present invention relates to a chain-off thread cutter for cutting a seam formed without being sewn onto a workpiece.

BACKGROUND ART

JP2019-058232A discloses a sewing machine including a chain-off thread cutter for cutting a chain-off thread. The chain-off thread cutter is provided in an opening portion formed in a throat plate of a sewing machine. A chain-off thread refers to a seam that is formed without being sewn onto a workpiece at the beginning or end of a chainstitch.

SUMMARY OF INVENTION

Foreign matter other than a chain-off thread must not be mistakenly cut by the chain-off thread cutter.

Accordingly, an object of the present invention is to provide a chain-off thread cutter which does not mistakenly cut a chain-off thread.

According to a first aspect of the present invention, there is provided a chain-off thread cutter for cutting a chain-off thread formed by a sewing machine, the chain-off thread cutter including:

- a fixed blade;
- a movable blade configured to move toward and away from the fixed blade;
- a driving unit configured to drive the movable blade to move the movable blade;
- a foreign matter detector configured to detect foreign matter present in a track of the movable blade; and
- a control unit configured to stop the driving unit when the foreign matter is detected by the foreign matter detector.

According to a second aspect of the present invention, there is provided a chain-off thread cutter for cutting a chain-off thread formed by a sewing machine, the chain-off thread cutter including:

- a single-edged fixed blade including a first cutting blade, a first blade back, and a first blade tip having an angle formed by the first cutting blade and the first blade back;
- a movable blade including a second cutting blade, a second blade back, and a second blade tip having an angle formed by the second cutting blade and the second blade back, in which the second blade tip is directed toward the first blade tip, the second blade back is directed toward the first blade back and brought into contact with the first blade back, and the movable blade configured to move toward and away from the fixed blade; and
- a movable cover provided to be relatively movable with respect to the movable blade along a track of the movable blade, moves together with the movable blade to approach the fixed blade following and preceding the movable blade, and moves away from the fixed blade following and lagging behind the movable blade.

The movable cover covers the second cutting blade from the second cutting blade to the vicinity of the second blade tip.

According to the first aspect of the present invention, when foreign matter present on the track of the movable blade is detected by the foreign matter detector, the control unit stops the driving unit, the movable blade is also stopped, and thus foreign matter may not be mistakenly cut by the movable blade.

According to the second aspect of the present invention, even when foreign matter comes into contact with the movable cover, the foreign matter does not come into contact with the second blade tip of the movable blade, and thus the foreign matter may not be mistakenly cut by the movable blade.

DESCRIPTION OF EMBODIMENTS

Figure 1:
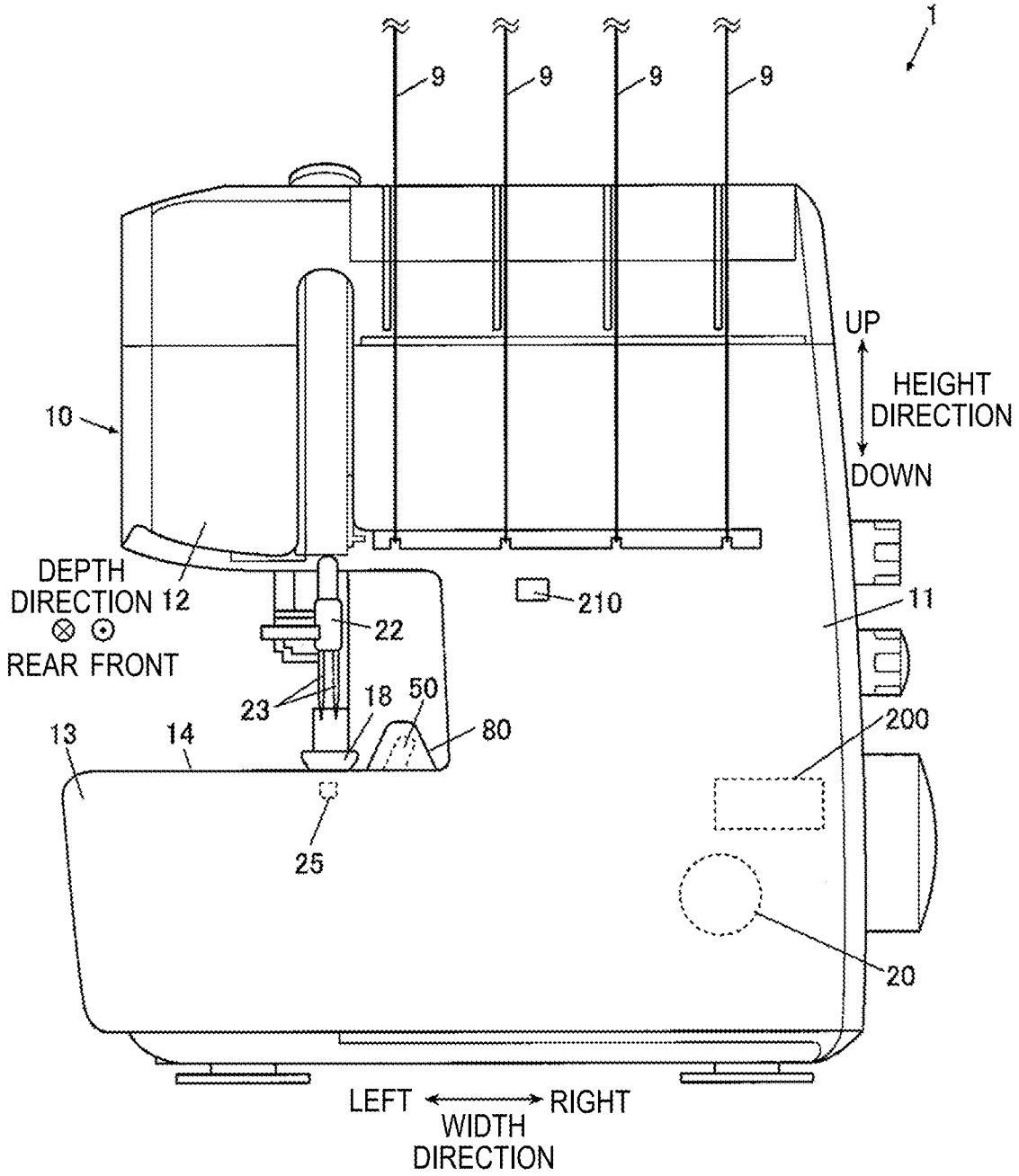
FIG. 1 is a front view of a sewing machine.

Embodiments will be described below with reference to the drawings. However, the scope of the present invention is not limited to the embodiments disclosed below. The drawings are provided for illustration only and the scope of the present invention is not limited to the illustration of the drawings.

1. Outline of Sewing Machine

The drawing shows arrows or symbols representing height direction, depth direction and width direction that are orthogonal to each other. The height direction is also referred to as an up-down direction, the depth direction is also referred to as a front-rear direction, and the width direction is also referred to as a left-right direction. The height direction is not necessarily vertical, but when a sewing machine 1 is placed on a horizontal surface, the height direction is the vertical direction. The left and right orientations are defined as viewed from the front of the sewing machine 1.

Figure 2:
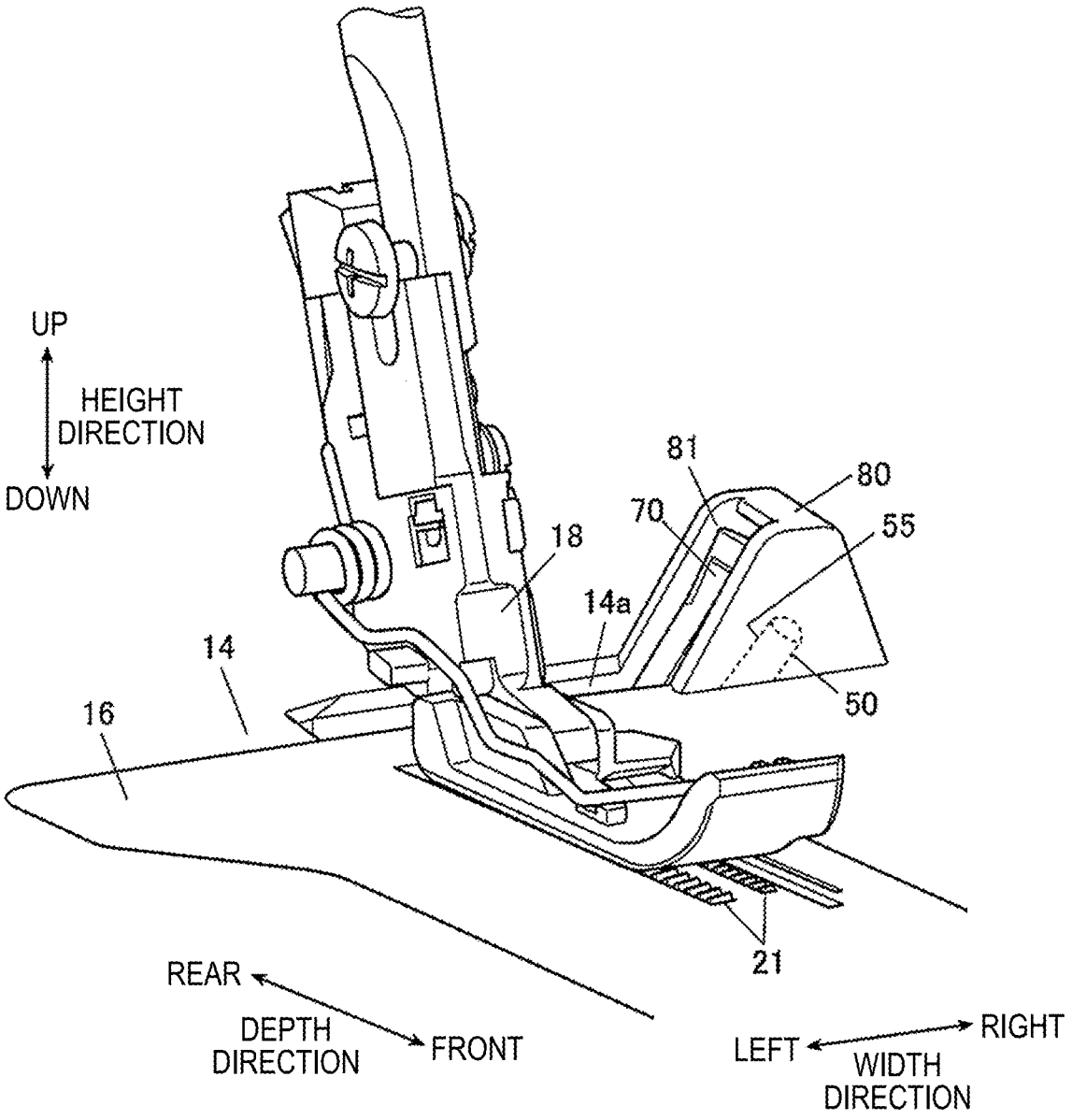
FIG. 2 is a perspective view illustrating a lower part of an arm portion of the sewing machine.

As illustrated in FIGS. 1 and 2, the sewing machine 1 is a so-called lock sewing machine that applies chainstitches, particularly double chainstitches, to a workpiece. In the specification, the chainstitch means not only a single chainstitch and a double chainstitch but also an overlock stitch.

The sewing machine 1 includes a sewing machine frame 10, a throat plate 16, a presser 18, a main motor 20, a feed dog 21, a needle bar 22, a plurality of sewing needles 23, a looper 25, and a chain-off thread cutter 30.

2. Sewing Machine Frame

The sewing machine frame 10 has a U-shape when viewed from the front. The sewing machine frame 10 has a vertical drum portion 11, an arm portion 12, and a bed portion 13.

The vertical drum portion 11 forms the right portion of the sewing machine frame 10. The vertical drum portion 11 is erected to extend in the up-down direction. The arm portion 12 forms the upper portion of the sewing machine frame 10 and extends leftward from the upper portion of the vertical drum portion 11. The bed portion 13 forms the lower portion of the sewing machine frame 10 and extends leftward from the lower portion of the vertical drum portion 11. The bed portion 13 has a flat bed surface 14 on the upper surface thereof, which extends in the front, rear, left, and right directions. The workpiece is sent from the front to the back on the bed surface 14 during sewing. A workpiece refers to a target to be sewn by the sewing machine 1, such as cloth.

3. Sewing Machine Motor

The main motor 20 is provided inside the lower portion of the vertical drum portion 11. The main motor 20 outputs power to a feed transmission mechanism, a needle bar transmission mechanism, and a looper transmission mechanism to raise and lower the needle bar 22, operate the feed dog 21 in an elliptical motion or box motion, and operate the looper 25 in a circular motion or reciprocating motion.

4. Throat Plate, Presser, and Feed Dog

The throat plate 16 is attached to the upper surface of the bed portion 13, and the upper surface of the throat plate 16 is flush with the bed surface 14. The throat plate 16 has a plurality of eyes, and when a sewing needle 23 described later is lowered, the sewing needle 23 is inserted into the eye, and when the sewing needle 23 is raised, the sewing needle 23 is removed from the eye.

The presser 18 hangs down from the bed portion 13 and is provided to be capable of being lowered or raised. The presser 18 is lowered to press the workpiece on the throat plate 16 from above. As a result, the workpiece is sandwiched between the presser 18 and the throat plate 16. When the presser 18 is raised and separated from the workpiece, the workpiece is released.

The feed dog 21 is disposed inside the hole of the throat plate 16 below the presser 18. The feed dog 21 is connected to the feed transmission mechanism inside the bed portion 13 and is provided to be capable of being operated in an elliptical motion or box motion by the feed transmission mechanism. The feed transmission mechanism is connected to the main motor 20, and the rotary motion of the main motor 20 is converted into an elliptical motion or box motion of the feed dog by the feed transmission mechanism. As a result, the workpiece is fed from the front to the back by the feed dog 21. Note that the elliptical motion refers to the feed dog 21 tracing along an elliptical trajectory that is long in the front-rear direction and short in the up-down direction. The box motion refers to the feed dog 21 tracing along a rectangular trajectory that is long in the front-rear direction and short in the up-down direction.

5. Needle Bar, Sewing Needle, and Looper

The needle bar 22 extends downward from the inside of the arm portion 12 to the outside. The needle bar 22 is connected to the needle bar transmission mechanism, such as a crank mechanism, inside the arm portion 12 to be capable of reciprocating in the up-down direction by the needle bar transmission mechanism. The needle bar transmission mechanism is connected to the main motor 20, and the rotary motion of the main motor 20 is converted into a raising/lowering motion of the needle bar 22 by the needle bar transmission mechanism.

A plurality of sewing needles 23 are attached to the lower end of needle bar 22 and extend downward from the lower end of needle bar 22. The sewing needles 23 are arranged at intervals in the left-right direction. Each thread 9 is guided from each spool to each sewing needle 23 and threaded through the holes of each sewing needle. Although the number of sewing needles 23 is two in FIG. 1, the number may be three or four.

The looper 25 is disposed inside the bed portion 13 below the needle bar 22. The looper 25 is connected to the looper transmission mechanism inside the bed portion 13 and is provided to be capable of operating in a circular motion or reciprocating motion by the looper transmission mechanism. The looper transmission mechanism is connected to the main motor 20, and the rotary motion of the main motor 20 is converted into a circular motion or reciprocating motion of the looper 25 by the looper transmission mechanism.

6. Formation of Seams and Chain-Off Threads

When the main motor 20 drives the feed dog 21, the needle bar 22, and the looper 25, the sewing needle 23 is operated in an up-down motion, the looper 25 is operated in a circular motion or reciprocating motion, and the feed dog 21 is operated in an elliptical motion or box motion. The workpiece is fed by the elliptical motion or box motion of the feed dog 21. The sewing needle 23 and the looper 25 cooperate with each other during feeding of the workpiece to apply a chainstitch, in particular a double chainstitch, to the workpiece. Specifically, each time the sewing needle 23 penetrates the workpiece downward, the looper 25 captures each thread 9 from each sewing needle 23 to form a loop of each thread 9, and the loops are entangled with the loop when the sewing needle 23 is lowered last time. A double chainstitch is a series of the loops.

A double chainstitch can be formed not only by being sewn onto a workpiece, but also by not sewing onto a workpiece. In other words, the needle 23 and the looper 25 cooperate with each other without the sewing needle 23 penetrating the workpiece when the workpiece is not present below the needle bar 22 at the beginning or end of sewing, or at both of the beginning and the end of sewing, to form a double chainstitch. A double chainstitch that is formed without being sewn onto a workpiece is referred to as a chain-off thread. Before or after the formation of the chain-off thread, or at both before and after the formation, a double chainstitch connecting the chain-off thread is sewn onto the workpiece by the sewing needle 23 and the looper 25.

The chain-off thread is cut by the chain-off thread cutter 30. The chain-off thread cutter 30 will be described in detail below.

7. Chain-Off Thread Cutter

Figure 3:
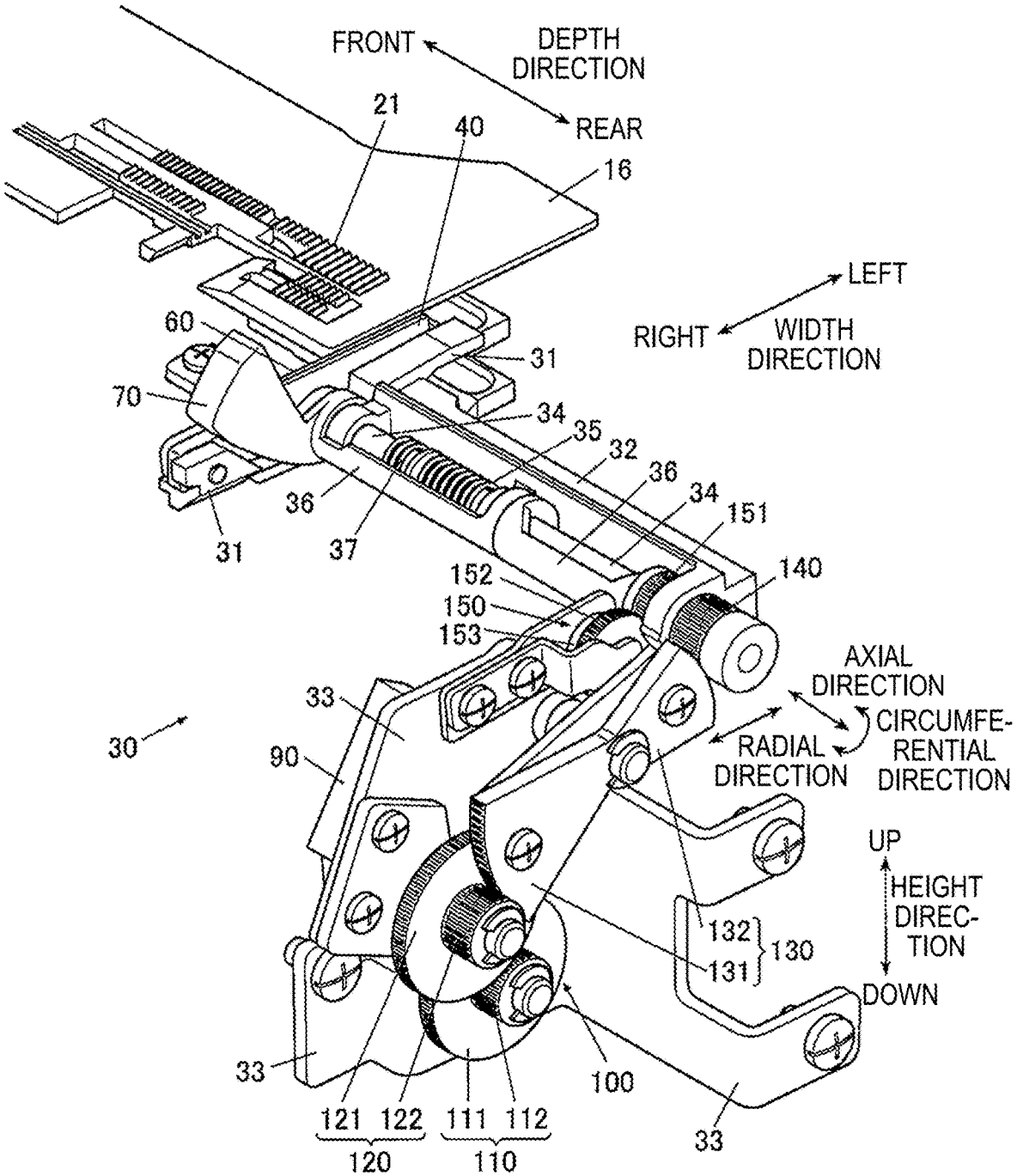
FIG. 3 is a perspective view illustrating a chain-off thread cutter.
Figure 4:
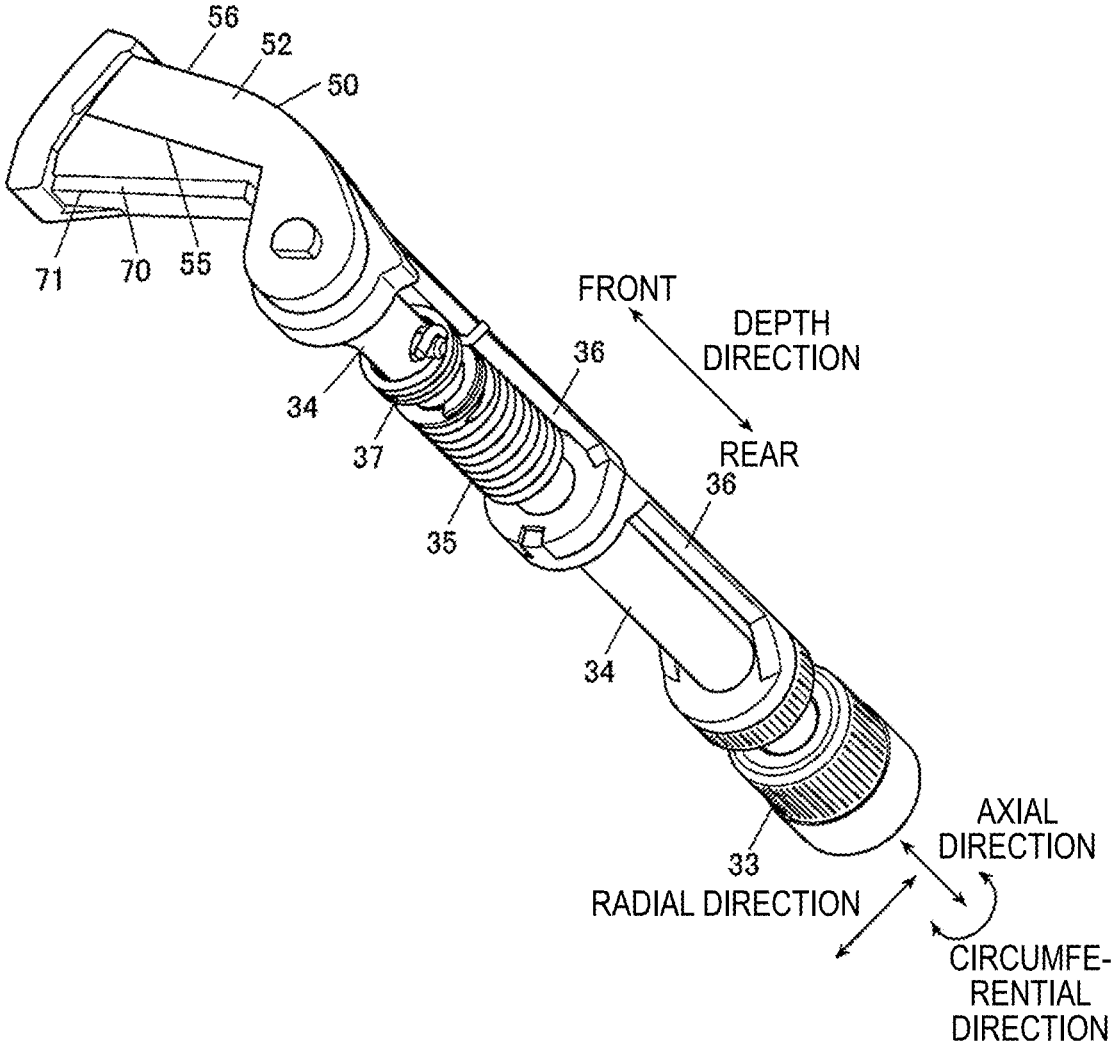
FIG. 4 is a perspective view illustrating a movable blade, a movable cover, a first shaft, and a second shaft.
Figure 5:
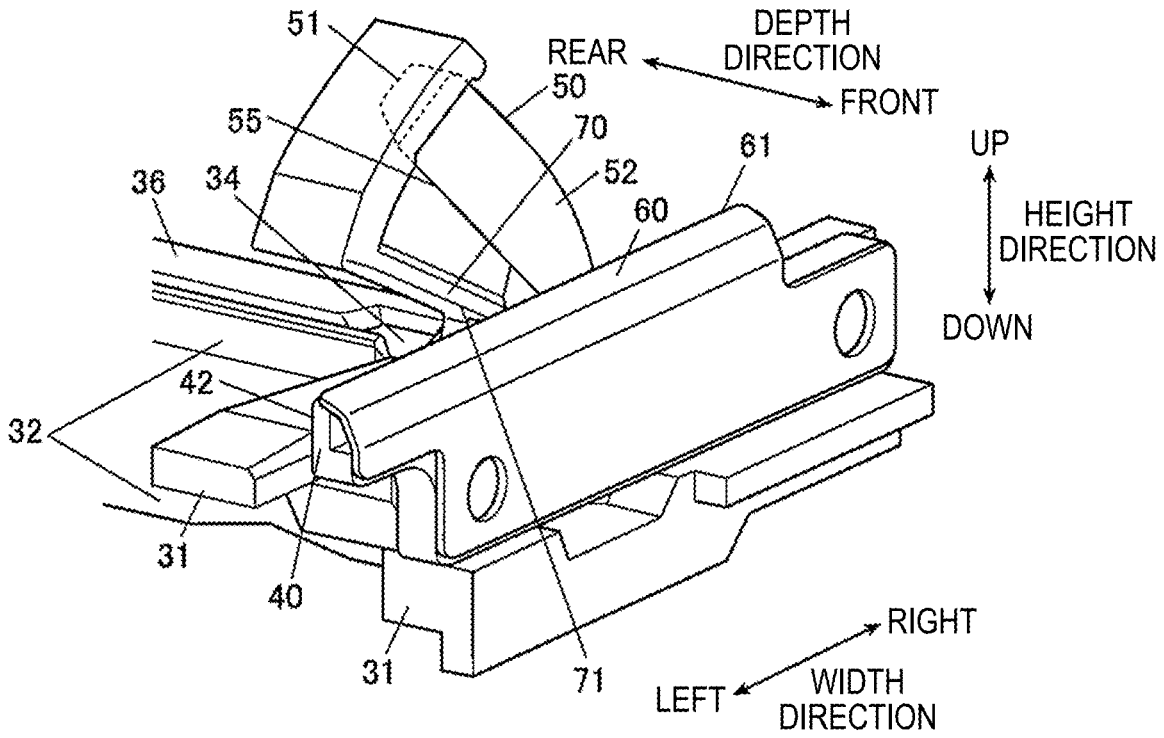
FIG. 5 is a perspective view illustrating a fixed blade, a fixed cover, the movable blade, and the movable cover.
Figure 6:
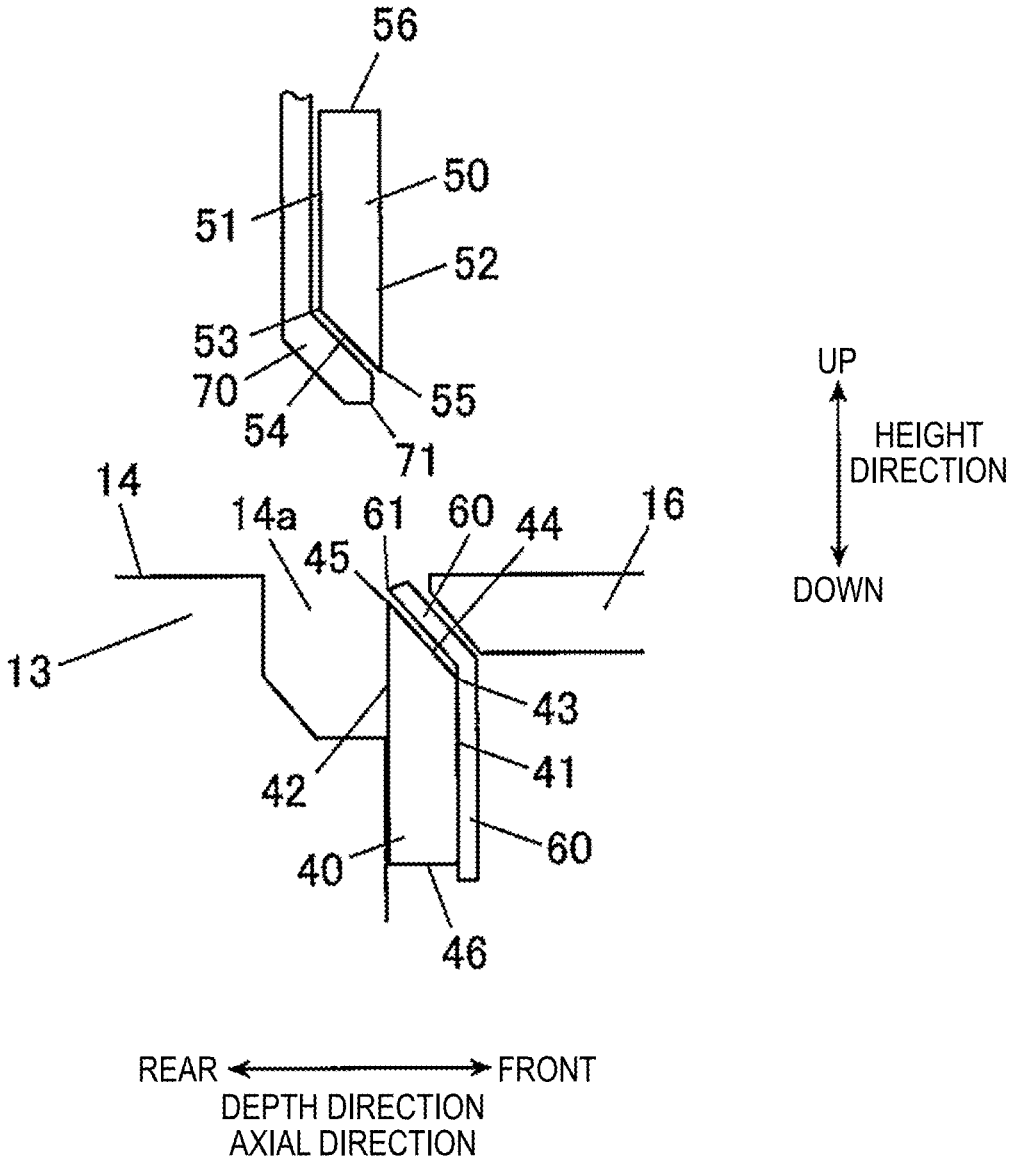
FIG. 6 is a side view illustrating the fixed blade, the fixed cover, the movable blade, and the movable cover.

FIG. 3 is a perspective view illustrating the chain-off thread cutter 30. FIG. 4 is a perspective view illustrating a movable blade 50, a movable cover 70, and shafts 34 and 36 of the chain-off thread cutter 30. FIG. 5 is a perspective view illustrating a fixed blade 40, the movable blade 50, a fixed cover 60, and the movable cover 70 of the chain-off thread cutter 30. FIG. 6 is a side view illustrating the fixed blade 40, the movable blade 50, the fixed cover 60, and the movable cover 70 of the chain-off thread cutter 30.

The chain-off thread cutter 30 is a cutter with a safety mechanism designed based on a fail-safe design concept. The chain-off thread cutter 30 includes brackets 31 to 33, a first shaft 34, a coil spring 35, a second shaft 36, a torsion spring 37, the fixed blade 40, the movable blade 50, the fixed cover 60, the movable cover 70, a standby station 80, a motor 90, a transmission mechanism 100, a displacement detector 150, a control unit 200 (refer to FIG. 1), and an operation button 210 (refer to FIG. 1). Here, the foreign matter detector includes the movable cover 70, the second shaft 36, and the displacement detector 150. The foreign matter detector detects foreign matter present in the track of the movable blade 50 above the bed surface 14. Foreign matter refers to any material other than thin flexible matter such as a thread or chain-off thread.

7-1. Bracket

As illustrated in FIG. 3, the brackets 31 to 33 are attached to the bed portion 13 inside the bed portion 13. The first bracket 31 is disposed below the rear portion of the throat plate 16 to extend in the width direction. The second bracket 32 is provided integrally with the first bracket 31 behind the first bracket 31 and extends rearward from the first bracket 31. The third bracket 33 is disposed on the lower right rear portion of the second bracket 32.

7-2. Shaft, Coil Spring, and Torsion Spring

As illustrated in FIGS. 3 and 4, the first shaft 34 is cylindrical. The first shaft 34 is attached to the second bracket 32 inside the bed portion 13 to extend in the depth direction. The first shaft 34 is disposed below the back of the throat plate 16.

The radial load of the first shaft 34 is received by the second bracket 32, and the first shaft 34 is supported by the second bracket 32 to be rotatable around the center axis thereof. When a first center axis extends in the front-rear direction, hereinafter, the direction parallel to the center axis of the first shaft 34 is referred to as an axial direction, the direction orthogonal to the center axis of the first shaft 34 is referred to as a radial direction, and the direction around the center axis of the first shaft 34 is referred to as a circumferential direction. The axial direction is parallel to the depth direction.

The first shaft 34 is connected to a transmission mechanism 100 which will be described later, and the power of the motor 90 is transmitted to the first shaft 34 by the transmission mechanism 100. Accordingly, the first shaft 34 rotates.

The coil spring 35 is wound around the first shaft 34. The coil spring 35 takes a reaction force from the second bracket 32 and urges the first shaft 34 forward. As a result, the movable blade 50, which will be described later, is pressed against the movable blade 50 from behind the fixed blade 40.

A part of the second shaft 36 has a ring shape and another part has a semi-cylindrical shape. The second shaft 36 is mounted on the first shaft 34 inside the bed portion 13 to be coaxial with the first shaft 34. The radial load of the second shaft 36 is received by the first shaft 34, and the second shaft 36 is supported by the first shaft 34 to be rotatable in the circumferential direction relative to the first shaft 34.

The torsion spring 37 is wound around the first shaft 34. One end of the torsion spring 37 is hooked on the first shaft 34 and the other end of the torsion spring 37 is hooked on the second shaft 36. Torque of the first shaft 34 is transmitted to the second shaft 36 by the torsion spring 37 and the second shaft 36 rotates together with the first shaft 34. However, when a resistance force is applied to the second shaft 36 while the first shaft 34 is rotating, the second shaft 36 stops or the rotational speed of the second shaft 36 decreases, causing the torsion spring 37 to twist.

The second shaft 36 is connected to the displacement detector 150, which will be described later. The displacement and rotational speed of the second shaft 36 are detected by the displacement detector 150, and a differential between the first shaft 34 and the second shaft 36 is detected by the displacement detector 150. The differential between the first shaft 34 and the second shaft 36 refers to the difference between the rotational speed of the first shaft 34 and the rotational speed of the second shaft 36, or the difference between the displacement of the first shaft 34 and the displacement of the second shaft 36. Typically, the differential between the first shaft 34 and the second shaft 36 is zero because the second shaft 36 rotates together with the first shaft 34. However, when a resistance force is applied to the second shaft 36 while the first shaft 34 is rotating, the differential between the first shaft 34 and the second shaft 36 exceeds zero.

7-3. Fixed Blade

As illustrated in FIG. 6, the single-edged fixed blade 40 has a blade face 41, a blade back 42, a ridge 43, a cutting blade 44, a blade tip 45, and a peak 46. The blade face 41 is the front side of the fixed blade 40, and the blade back 42 is the back side of the fixed blade 40. The cutting blade 44 is sharpened from the ridge 43 to the blade tip 45 to be inclined with respect to the blade face 41 on the tip end side of the blade face 41. The cutting blade 44 is also referred to as a blade surface. The blade tip 45 is an acute angle formed by the cutting blade 44 and the blade back 42.

As illustrated in FIGS. 3, 5, and 6, the fixed blade 40 is attached to the first bracket 31 inside the bed portion 13 and disposed below the rear end of the throat plate 16. Regarding the posture of the fixed blade 40 when the fixed blade 40 is attached to the first bracket 31, the blade tip 45 is directed upward, the peak 46 is directed downward, the blade face 41 is directed forward, the blade back 42 is directed rearward, and the blade tip 45 extends in the width direction and radial direction.

As illustrated in FIG. 2, a slit 14*a* is formed in the bed surface 14 of the bed portion 13 along the rear end of the throat plate 16, and the fixed blade 40 is disposed along the rear end of the throat plate 16 below the slit 14*a*.

7-4. Fixed Cover

As illustrated in FIGS. 3, 5, and 6, the fixed cover 60 is attached to the first bracket 31 and the fixed blade 40 within the bed portion 13. The fixed cover 60 is disposed below the rear end of the throat plate 16 and is disposed in front of the fixed blade 40. The fixed cover 60 covers the blade face 41 and the cutting blade 44 of the fixed blade 40 from the blade face 41 to the vicinity of the blade tip 45. The fixed cover 60 protrudes above the blade tip 45 of the fixed blade 40, and the upper and rear edge 61 of the fixed cover 60 extends along the blade tip 45 of the fixed blade 40. The edge 61 of the fixed cover 60 is positioned above the blade tip 45 of the fixed blade 40 and positioned slightly ahead of the blade tip 45 and the blade back 42 of the fixed blade 40. The fixed cover 60 is slightly separated forward from a track surface of the movable blade 50. The track surface of the movable blade 50 refers to the surface drawn by the blade tip 55 of the movable blade 50 as the movable blade 50 turns.

7-5. Movable Blade

As illustrated in FIG. 6, the single-edged movable blade 50 has a blade face 51, a blade back 52, a ridge 53, a cutting blade 54, a blade tip 55, and a peak 56. The blade face 51 is the front side of the fixed blade 50, and the blade back 52 is the back side of the movable blade 50. The cutting blade 54 is sharpened from the ridge 53 to the blade tip 55 to be inclined with respect to the blade face 51 on the blade tip 55 side of the blade face 51. The cutting blade 54 is also referred to a blade surface. The blade tip 55 is an acute angle formed by the cutting blade 54 and the blade back 52.

As illustrated in FIGS. 3, 5, and 6, the movable blade 50 is disposed behind the fixed blade 40 in close proximity to the blade back 42 of the fixed blade 40. The movable blade 50 is attached to the second bracket 32 via the first shaft 34 in the bed portion 13 and is turnable in the circumferential direction. Specifically, as illustrated in FIGS. 3 and 4, the movable blade 50 is fixed to the front end of the first shaft 34, and the relative rotation of the first shaft 34 with respect to the second bracket 32 causes the movable blade 50 to turn in the circumferential direction. The movable blade 50 is provided outward in the radial direction from the front end of the first shaft 34.

As illustrated in FIGS. 3, 5, and 6, regarding the posture of the movable blade 50 when the movable blade 50 is turnably attached to the second bracket 32 via the first shaft 34, the blade face 51 is directed rearward, the blade back 52 is directed forward, the blade tip 55 is directed toward the blade tip 45 of the fixed blade 40 in the circumferential direction, and the blade tip 55 extends in the radial direction. The blade back 52 of the movable blade 50 and the blade back 42 of the fixed blade 40 face each other in the axial direction, and the blade back 52 of the movable blade 50 is pressed against the blade back 42 of the fixed blade 40 by the elastic force of the coil spring 35.

The movable blade 50 and the fixed blade 40 can be opened and closed because the movable blade 50 can turn relative to the fixed blade 40 to come into contact with and be separated from the fixed blade 40. Specifically, the movable blade 50 and the fixed blade 40 are closed as the movable blade 50 turns to the left and is swung down toward the fixed blade 40. The movable blade 50 and the fixed blade 40 are opened as the movable blade 50 turns to the right and is swung up from the fixed blade 40.

When the movable blade 50 and the fixed blade 40 are opened, the movable blade 50 protrudes upward from the slit 14*a* as illustrated in FIG. 2, and the position of the movable blade 50 here is the standby position and the initial position. When the movable blade 50 and the fixed blade 40 are closed, the movable blade 50 enters the slit 14*a*.

As illustrated in FIG. 6, the track surface of the movable blade 50 is spaced rearward from the fixed cover 60. That is, the track surface of the movable blade 50 is separated rearward from the upper and rear edge 61 of the fixed cover 60. Therefore, even when the movable blade 50 turns to the left to be swung down toward the fixed blade 40, the movable blade 50 does not come into contact with the fixed cover 60.

7-6. Movable Cover

As illustrated in FIGS. 3 and 4, the movable cover 70 and the second shaft 36 are integrally formed, and the movable cover 70 is provided outward in the radial direction from the front end of the second shaft 36. Since the second shaft 36 is rotatable in the circumferential direction relative to the first shaft 34, the movable cover 70 is turnable in the circumferential direction relative to the movable blade 50. The turning track of the movable cover 70 is along the turning trajectory of the movable blade 50. Since the torque of the first shaft 34 is transmitted to the second shaft 36 by the torsion spring 37, the movable cover 70 turns together with the movable blade 50. Specifically, when the movable blade 50 turns to the left to be swung up toward the fixed blade 40, the movable cover 70 follows and precedes the movable blade 50 and is swung down together with the movable blade 50. When the movable blade 50 turns to the right to be swung up from the fixed blade 40, the movable cover 70 follows and lags behind the movable blade 50 and is swung up together with the movable blade 50. However, when a resistance force is applied to the movable cover 70 while the movable blade 50 is turning, the movable cover 70 stops or the turning speed of the movable cover 70 decreases, and the torsion spring 37 twists. When the resistance force is eliminated, the torsion of the torsion spring 37 is eliminated.

When the movable blade 50 and the fixed blade 40 are opened, the movable cover 70 protrudes upward from the slit 14*a* as illustrated in FIG. 2, and the position of the movable cover 70 here is the standby position and the initial position. When the movable blade 50 and the fixed blade 40 are closed, the movable cover 70 enters the slit 14*a*.

As illustrated in FIGS. 4 to 6, the movable cover 70 is disposed behind the movable blade 50 and covers the blade face 51 and the cutting blade 54 of the movable blade 50 from the blade face 51 to the vicinity of the blade tip 55 of the movable blade 50. The movable cover 70 protrudes toward the fixed blade 40 from the blade tip 55 of the movable blade 50 in the circumferential direction. An edge 71 of the movable cover 70 near the fixed blade 40 and the fixed cover 60 (the edge 71 is also the front edge of the movable cover 70) is separated from the blade tip 55 of the movable blade 50 toward the fixed blade 40. The track surface of the movable cover 70 is slightly separated rearward from the track surface of the movable blade 50. The track surface of the movable cover 70 refers to the surface drawn by the edge 71 of the movable cover 70 as the movable cover 70 turns.

The track surface of the movable cover 70 is slightly spaced rearward from the blade tip 45 of the fixed blade 40 and the rear edge 61 of the fixed cover 60. Therefore, even when the movable cover 70 turns to the left to approach the fixed blade 40 and the fixed cover 60, the movable cover 70 does not come into contact with the fixed blade 40 and the fixed cover 60.

The movable cover 70 is a probe that searches for foreign matter present in the track of the movable blade 50 above the bed surface 14. A probe is also called a detection member or a probe device.

7-8. Standby Station

The standby station 80 is provided on the bed portion 13 to protrude upward from the bed surface 14 of the bed portion 13. The standby station 80 covers the right side of the slit 14*a* from above. The standby station 80 is provided in a box shape to have a hollow, and the bottom of the hollow communicates with the right portion of the slit 14*a*. The standby station 80 has a slit 81 on the left side surface thereof, and the slit 81 communicates with the hollow of the standby station 80.

When the movable blade 50 and the fixed blade 40 are opened, the movable blade 50 and the movable cover 70 enter the hollow of the standby station 80 from the right portion of the slit 14*a*, and the positions of the movable blade 50 and the movable cover 70 here is the standby position and the initial position. When the movable blade 50 and the movable cover 70 turn toward the fixed blade 40 here, the movable blade 50 and the movable cover 70 move out of the standby station 80 through the slit 81.

7-9. Motor

The motor 90 as a driving unit is attached to the third bracket 33. The motor 90 has a pinion on the output shaft thereof. The motor 90 is connected to the transmission mechanism 100 via an output gear and outputs torque to the transmission mechanism 100.

The motor 90 is controlled by the control unit 200.

7-10. Transmission Mechanism

The transmission mechanism 100 is a speed reducer that transmits the torque of the motor 90 to the first shaft 34 and converts the rotary motion of the motor 90 into the rotary motion of the first shaft 34. That is, the transmission mechanism 100 reduces the rotational speed of the motor 90 and outputs the rotational speed to the first shaft 34, and increases the torque of the motor 90 and outputs the torque to the first shaft 34.

The transmission mechanism 100 includes a first double gear 110, a second double gear 120, a third double gear 130, and a gear 140. The double gears 110, 120, and 130 are rotatably supported by the third bracket 33 such that the rotation axes thereof are parallel to each other.

The first double gear 110 includes a large gear 111 and a small gear 112 coaxial with each other. The second double gear 120 includes a large gear 121 and a small gear 122 coaxial with each other. The third double gear 130 includes a large sector gear 131 and a small sector gear 132 coaxial with each other. The large gear 111 of the first double gear 110 meshes with the output gear of the motor 90. The small gear 112 of the first double gear 110 meshes with the large gear 121 of the second double gear 120. The small gear 122 of the second double gear 120 meshes with the large sector gear 131 of the third double gear 130. The small sector gear 132 of the third double gear 130 meshes with the gear 140. The gear 140 is attached to the first shaft 34 to be coaxial with the first shaft 34.

7-11. Displacement Detector

The displacement detector 150 detects the displacement of the second shaft 36. That is, the displacement detector 150 detects the displacement of the movable cover 70. The displacement detector 150 is also a speed detector that detects the rotational speed of the second shaft 36 and the turning speed of the movable cover 70.

The displacement detector 150 includes gears 151 and 152 and a rotary encoder 153. The gear 151 is attached to the second shaft 36 to be coaxial with the second shaft 36. The gear 152 meshes with the gear 151. The gear 152 is rotatably attached to the third bracket 33. The rotary encoder 153 is connected to the gear 152. When the gear 152 rotates, the rotary encoder 153 outputs a pulse signal to the control unit 200, and accordingly, the displacement or turning speed of the movable cover 70 is detected by the displacement detector 150 and recognized by the control unit 200.

7-12. Operation Button

The operation button 210 is provided on the sewing machine frame 10, specifically on the outer surface of the sewing machine frame 10, and more specifically on the front surface of the vertical drum portion 11. The operation button 210 includes a tactile switch, a momentary switch, a dome switch, a membrane switch, a pressure-sensitive switch, a touch sensor, a touch panel, or an electrostatic sensor. When the user operates the operation button 210 by pressing or touching, an operation signal about the operation is output to the control unit 200 by the operation button 210.

7-13. Control Unit

The control unit 200 includes a CPU, a RAM, a ROM, a signal processing circuit, and a motor driver. Using the RAM as a work area, the CPU executes processing according to programs recorded in the ROM, and controls the signal processing circuit and the motor driver according to the programs. The signal processing circuit processes the output signal of the rotary encoder 153. The motor driver drives the motor 90.

The control unit 200 monitors the displacement or speed detected by the displacement detector 150, that is, the pulse signal that is the output signal of the rotary encoder 153. Here, since the control unit 200 controls the motor 90 by an open loop method or a closed loop method, the control unit 200 recognizes the displacement or rotational speed of the motor 90, that is, the displacement or turning speed of the movable blade 50. Therefore, when the control unit 200 inputs a pulse signal from the rotary encoder 153, the differential between the movable blade 50 and the movable cover 70 is detected by the displacement detector 150 and recognized by the control unit 200. Therefore, the displacement detector 150 is also a differential detector that detects a differential between the movable blade 50 and the movable cover 70. The differential between the movable blade 50 and the movable cover 70 refers to the difference between the turning speed of the movable blade 50 and the turning speed of the movable cover 70 or the difference between the displacement of the movable blade 50 and the displacement of the movable cover 70.

The control unit 200 controls the motor 90 when an operation signal is input from the operation button 210. Specifically, when the control unit 200 rotates the motor 90 forward at a predetermined rotational speed, the movable blade 50 turns to the left to be swung down toward the fixed blade 40 by the power of the motor 90. After that, when the control unit 200 reverses the motor 90 backwards at a predetermined rotational speed, the movable blade 50 turns to the right to be swung up from the fixed blade 40 by the power of the motor 90. The operation of the chain-off thread cutter 30 when the control unit 200 controls the motor 90 as such will be described in detail below.

7-14. Chain-Off Tread Cutter Operation 7-14-1. Standby

Figure 7:
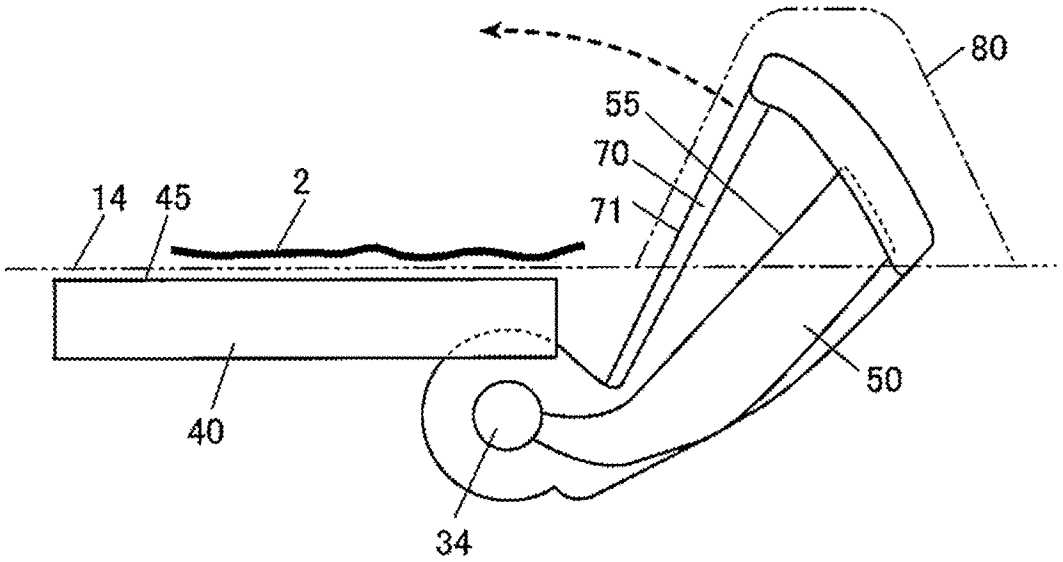
FIG. 7 is a front view for describing movements of the movable blade and the movable cover relative to the fixed blade.

Before the user operates the operation button 210, the movable blade 50 and the movable cover 70 are inserted into the hollow of the standby station 80 from the right portion of the slit 14*a*, as illustrated in FIG. 7. Here, the control unit 200 monitors the signal transferred from the operation button 210.

7-14-2. Normal Operation

The user sets a chain-off thread 2 on the bed surface 14 of the bed portion 13 such that the chain-off thread 2 crosses over the slit 14*a* in the depth direction. When the user presses or touches the operation button 210, the control unit 200 detects input of an operation signal from the operation button 210. Since such detection triggers the control unit 200 to start driving the motor 90, the control unit 200 rotates the motor 90 forward at a predetermined rotational speed.

Then, as illustrated in the order of FIGS. 7, 8A, 8B, 9, 10A, and 10B, the movable blade 50 turns to the left to be swung down toward the fixed blade 40 by the power of the motor 90, and the movable cover 70 follows and precedes the movable blade 50 and is swung down toward the fixed blade 40. During forward rotation of the motor 90, the control unit 200 monitors the pulse signal of the rotary encoder 153, that is, the differential detected by the displacement detector 150. Specifically, the control unit 200 compares the differential detected by the displacement detector 150 with a predetermined threshold value. The differential detected by the displacement detector 150 represents the difference between the displacement of the movable blade 50 and the displacement of the movable cover 70, the difference between the turning speed of the movable blade 50 and the turning speed of the movable cover 70, the displacement of the movable cover 70, and the turning speed of the movable cover 70.

Figure 8A:
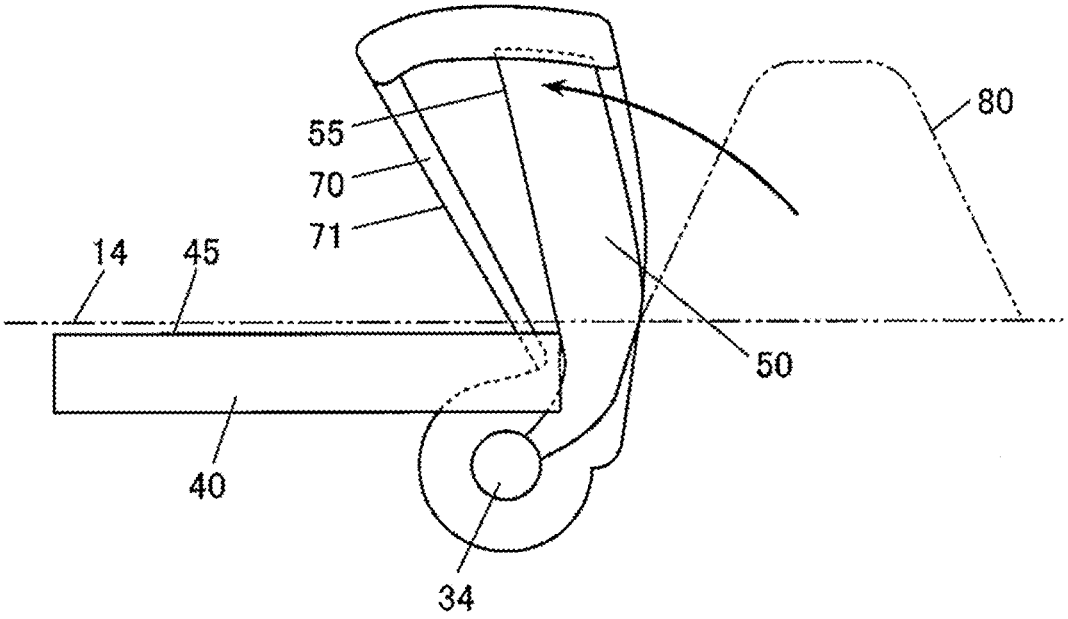
FIG. 8A is a front view for describing movements of the movable blade and the movable cover relative to the fixed blade.
Figure 8B:
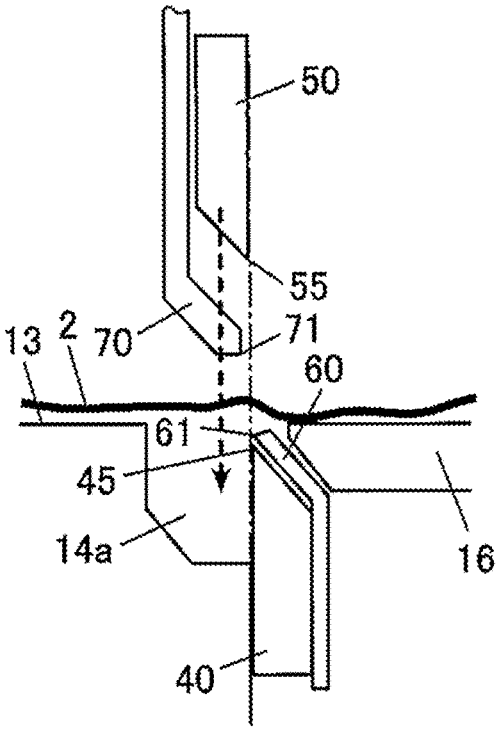
FIG. 8B is a side view for describing movements of the movable blade and the movable cover relative to the fixed blade and the fixed cover.

As illustrated in FIGS. 7 to 8B, the movable blade 50 and the movable cover 70 turn at the same turning speed until the movable cover 70 touches the chain-off thread 2 while the movable blade 50 and the movable cover 70 are swinging down, and the differential between the movable blade 50 and the movable cover 70 is zero. Therefore, the control unit 200 determines that the differential detected by the displacement detector 150 is less than the predetermined threshold value.

Figure 9:
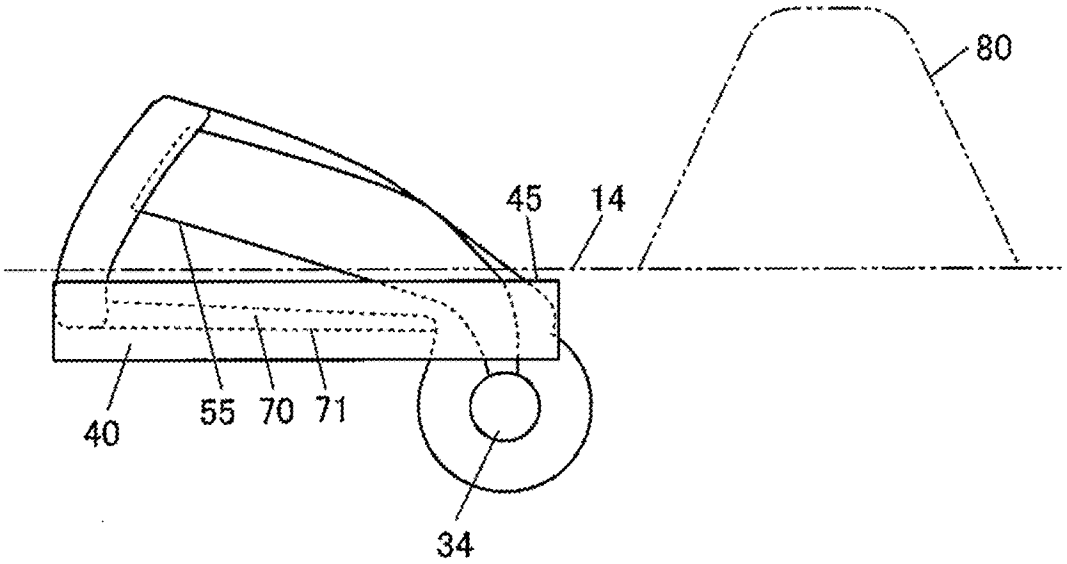
FIG. 9 is a front view for describing movements of the movable blade and the movable cover relative to the fixed blade.

After the movable cover 70 touches the chain-off thread 2 and enters the slit 14*a* as illustrated in FIG. 9, the movable cover 70 receives a resistance force from the chain-off thread 2, and thus, the turning speed of the movable cover 70 becomes smaller than the turning speed of the movable blade 50, and the differential between the movable blade 50 and the movable cover 70 becomes larger than zero. However, after the movable cover 70 enters the slit 14*a*, the control unit 200 stops monitoring the differential detected by the displacement detector 150. Therefore, after the movable cover 70 enters the slit 14*a*, the swinging down of the movable blade 50 and the movable cover 70 is continued without the control unit 200 stopping the motor 90.

Figure 10A:
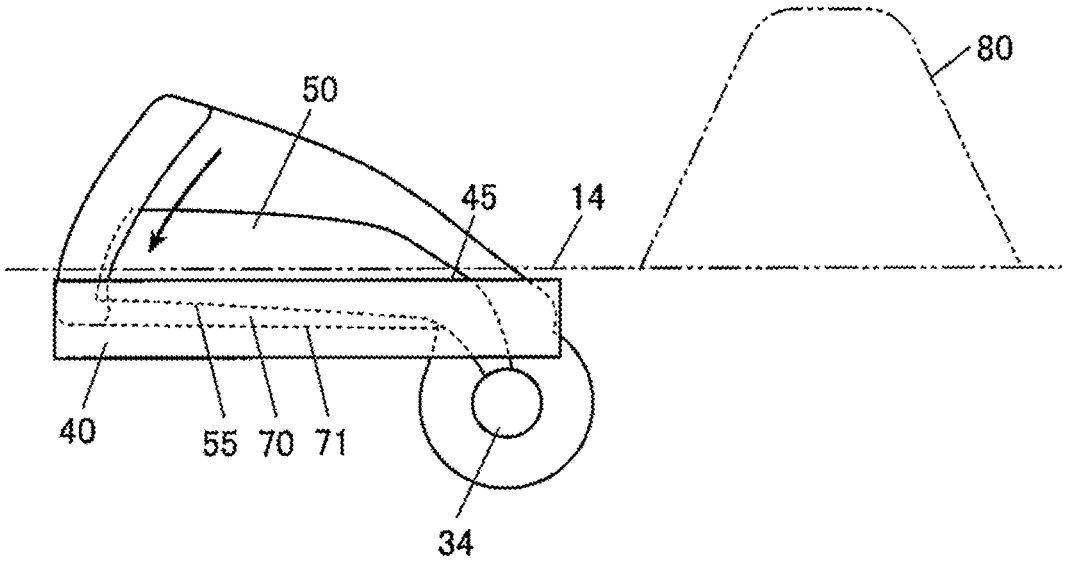
FIG. 10A is a front view for describing movements of the movable blade and the movable cover relative to the fixed blade.
Figure 10B:
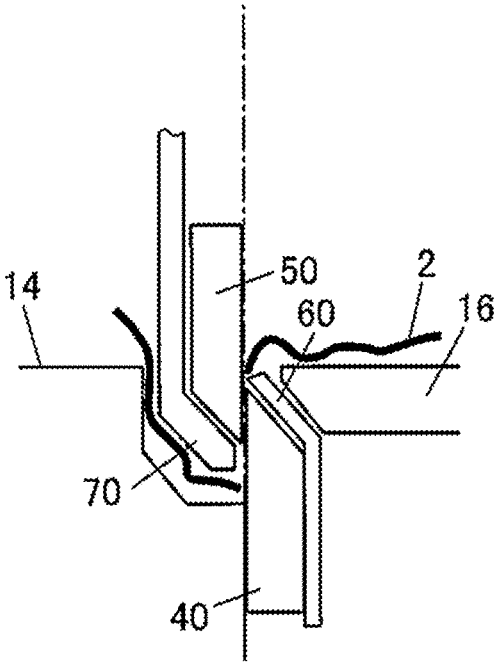
FIG. 10B is a side view for describing movements of the movable blade and the movable cover relative to the fixed blade and the fixed cover.

As illustrated in FIGS. 10A and 10B, when the movable blade 50 enters the slit 14*a* together with the movable cover 70, the movable blade 50 and the fixed blade 40 are closed, and the movable blade 50 and the fixed blade 40 cut the chain-off thread 2 by shearing.

Then, the control unit 200 stops the motor 90, and the movable blade 50 and the movable cover 70 stop while the movable blade 50 and the fixed blade 40 are closed.

After that, the control unit 200 rotates the motor 90 backwards at a predetermined rotational speed. Then, the movable blade 50 turns to the right by the power of the motor 90 to be swung up from the fixed blade 40, and the movable cover 70 follows and lags behind the movable blade 50 and is swung up from the fixed blade 40. When the movable blade 50 and the movable cover 70 come out of the slit 14*a* and enter the inside of the standby station 80, the control unit 200 stops the motor 90. Therefore, the movable blade 50 and the movable cover 70 are stopped while the movable blade 50 and the fixed blade 40 are open.

7-14-3. Operation when Foreign Matter is Detected

Figure 11A:
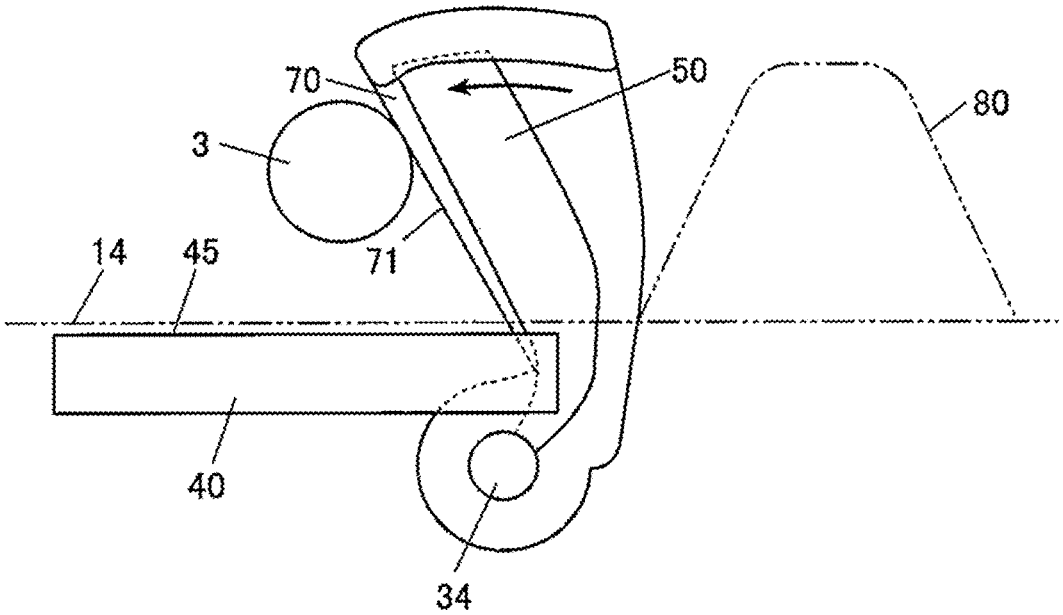
FIG. 11A is a front view for describing movements of the movable blade and the movable cover relative to the fixed blade.
Figure 11B:
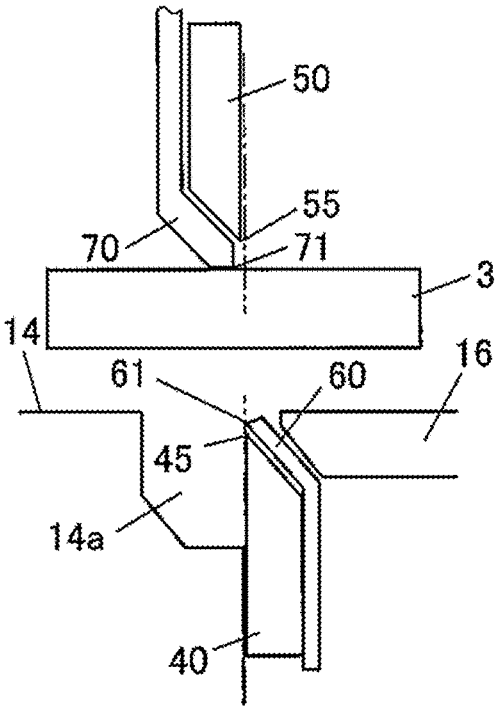
FIG. 11B is a side view for describing movements of the movable blade and the movable cover relative to the fixed blade and the fixed cover.

As illustrated in FIGS. 11A and 11B, a case where foreign matter 3 is present in the track of the movable blade 50 will be described.

When the user presses or touches the operation button 210, the control unit 200 causes the motor 90 to rotate forward at a predetermined rotational speed. The movable blade 50 turns to the left to be swung down toward the fixed blade 40 by the power of the motor 90, and the movable cover 70 follows and precedes the movable blade 50 and is swung down toward the fixed blade 40. During forward rotation of the motor 90, the control unit 200 compares the differential detected by the displacement detector 150 with a predetermined threshold value.

When the movable cover 70 comes into contact with the foreign matter 3, the movable cover 70 stops or the turning speed of the movable cover 70 greatly decreases while the movable blade 50 continues to turn. Therefore, the differential between the movable blade 50 and the movable cover 70 increases and becomes equal to or greater than the predetermined threshold value. Such situation corresponds to detection of the foreign matter 3 by the foreign matter detector.

When the differential between the movable blade 50 and the movable cover 70 becomes equal to or greater than a predetermined threshold value, the control unit 200 determines that the differential detected by the displacement detector 150 is equal to or greater than the predetermined threshold value. As a result, the control unit 200 stops the motor 90. Therefore, the movable blade 50 stops without the movable blade 50, especially the blade tip 55, coming into contact with the foreign matter 3. Therefore, damage to the foreign matter 3 can be prevented.

Immediately after the motor 90 stops, the control unit 200 rotates the motor 90 backwards at a predetermined rotational speed. Then, the movable blade 50 turns toward the standby station 80 by the power of the motor 90, and the movable cover 70 follows and lags behind the movable blade 50 and turns toward the standby station 80. When the movable blade 50 and the movable cover 70 enter the inside of the standby station 80, the control unit 200 stops the motor 90. Therefore, the movable blade 50 and the movable cover 70 are stopped while the movable blade 50 and the fixed blade 40 are open.

7-14-4. Fail-Safe

For some reason, the motor 90 may not stop even when the movable cover 70 comes into contact with the foreign matter 3 due to malfunction or failure of the control unit 200 or the rotary encoder 153, for example. Here, since the movable cover 70 comes into contact with the foreign matter 3, the blade tip 55 of the movable blade 50 does not come into contact with the foreign matter 3. After the movable cover 70 comes into contact with the foreign matter 3, a resistance force acts on the movable blade 50 from the foreign matter 3 through the movable cover 70, and thus the motor 90 is forcibly stopped even when the motor 90 is energized. The resistance force is small, and even when the foreign matter 3 is pressed toward the fixed blade 40 by the power of the motor 90, the foreign matter 3 comes into contact with the fixed cover 60 and does not come into contact with the blade tip 45 of the fixed blade 40. Therefore, the foreign matter 3 is not mistakenly cut.

8. Advantageous Technical Effects 8-1. When the foreign matter 3 is detected by the foreign matter detector during forward rotation of the motor 90, that is, when the movable cover 70 comes into contact with the foreign matter such that a differential occurs between the movable blade 50 and the movable cover 70 and the differential is detected by the rotary encoder 153, the control unit 200 stops the motor 90 and rotates the motor 90 backwards. Therefore, the movable blade 50, especially the blade tip 55 thereof, does not come into contact with the foreign matter 3, and the foreign matter 3 is not mistakenly cut by the movable blade 50.

8-2. The movable cover 70 is swung down following and preceding the movable blade 50. Therefore, even when the foreign matter 3 is present on the track of the movable blade 50 and the movable cover 70, only the movable cover 70 comes into contact with the foreign matter 3, and the blade tip 55 of the movable blade 50 does not come into contact with the foreign matter 3. Therefore, the foreign matter 3 is not mistakenly cut by the movable blade 50.

8-3. Even when the foreign matter 3 mistakenly enters the slit 14*a*, the foreign matter 3 only comes into contact with the fixed cover 60 and does not come into contact with the blade tip 45 of the fixed blade 40. Therefore, the foreign matter 3 is not mistakenly cut by the fixed blade 40.

8-4. Fail-safe is implemented. In other words, even when the motor 90 operates due to malfunction without the user pressing the operation button 210, and even when the foreign matter 3 is mistakenly not detected due to malfunction or failure of the control unit 200 or the rotary encoder 153 during forward rotation of the motor 90, the movable cover 70 comes into contact with the foreign matter 3, and thus the foreign matter 3 is not mistakenly cut by the movable blade 50.

8-5. Since the movable blade 50 is hidden inside the standby station 80 during standby, the movable blade 50 does not mistakenly damage foreign matters, threads, chain-off threads, and the like.

8-6. Since the fixed blade 40 is disposed under the slit 14*a*, the fixed blade 40 does not mistakenly damage foreign matters, threads, chain-off threads, and the like.

9. Modification Example

Note that the present invention is not limited to the above embodiments. For example, the above embodiments may be modified as follows.

9-1. In the above embodiment, the fixed cover 60 covers the cutting blade 44 from the cutting blade 44 of the fixed blade 40 to the vicinity of the blade tip 45. On the other hand, the fixed blade 40 may be disposed below the throat plate 16, and instead of the fixed cover 60, the throat plate 16 may cover the cutting blade 44 from the cutting blade 44 of the fixed blade 40 to the vicinity of the blade tip 45. Here, the rear edge of the throat plate 16 forms the edge of the slit 14*a*, and the edge is along the blade tip 45 of the fixed blade 40. The rear edge of the throat plate 16 is positioned above the blade tip 45 of the fixed blade 40 and positioned slightly ahead of the blade tip 45 and the blade back 42 of the fixed blade 40.

9-2. In the above embodiment, the movable blade 50 is rotatably provided, but the movable blade 50 may be provided to be linearly movable in the height direction by a guide. Here, the movable cover 70 is attached to the movable blade 50 to be linearly movable relative to the movable blade 50 in the height direction, and is pressed against the stopper upward by a spring or the like. When the movable blade 50 is driven downward by a driving unit such as a motor and an electromagnetic solenoid, the movable cover 70 is lowered following and preceding the movable blade 50. When the movable cover 70 comes into contact with the foreign matter, the blade tip 55 of the movable blade 50 does not come into contact with the foreign matter. A differential occurs between the movable cover 70 and the movable blade 50, the differential is detected by the differential detector, and the control unit 200 stops the driving unit and causes the driving unit to perform reverse operation. Thus, the movable blade 50 moves upwards away from the foreign matter. When the movable cover 70 does not come into contact with the foreign matter, the fixed blade 40 and the movable blade 50 cut the chain-off thread.

9-3. In the above embodiment, the foreign matter detector uses the movable cover 70 and the rotary encoder 153, but the foreign matter detector may use a reflective or transmissive optical sensor. Here, for example, the optical sensor projects light along the track of the movable blade 50, and when foreign matter is present on the track of the movable blade 50, the light emitted from the optical sensor is blocked by the foreign matter, and thus the foreign matter is detected by the optical sensor.

What is claimed is:

1. A chain-off thread cutter for cutting a chain-off thread formed by a sewing machine, the chain-off thread cutter comprising:
- a fixed blade;
- a movable blade configured to move toward and away from the fixed blade;
- a driving unit configured to drive the movable blade to move the movable blade;
- a foreign matter detector configured to detect foreign matter present in a track of the movable blade, the foreign matter detector including a probe; and
- a control unit configured to stop the driving unit when the foreign matter is contacted by the probe, wherein
- the probe is provided to be:
  - relatively movable with respect to the movable blade along the track of the movable blade,
  - movable together with the movable blade to approach the fixed blade following and preceding the movable blade, and
  - movable away from the fixed blade following and lagging behind the movable blade,
- the foreign matter detector further includes a differential detector that detects a differential between the movable blade and the probe, and
- the control unit is configured to stop the driving unit when the differential detector detects a differential between the movable blade and the probe caused by the contact of the probe with the foreign matter.

2. The chain-off thread cutter according to claim 1, wherein
- the probe is a cover that covers a cutting blade of the movable blade from the cutting blade up to a blade tip of the movable blade.

3. The chain-off thread cutter according to claim 1, wherein
- the differential detector includes a rotary encoder that detects displacement or speed of the probe.

4. The chain-off thread cutter according to claim 2, wherein
- the differential detector includes a rotary encoder that detects displacement or speed of the probe.

5. A chain-off thread cutter for cutting a chain-off thread formed by a sewing machine, the chain-off thread cutter comprising:
- a single-edged fixed blade including a first cutting blade, a first blade back, and a first blade tip having an angle formed by the first cutting blade and the first blade back;
- a movable blade including a second cutting blade, a second blade back, and a second blade tip having an angle formed by the second cutting blade and the second blade back, in which the second blade tip is directed toward the first blade tip, the second blade back is directed toward the first blade back and is configured to be brought into contact with the first blade back, and the movable blade configured to move toward and away from the fixed blade; and a movable cover provided to be:

relatively movable with respect to the movable blade along a track of the movable blade, movable together with the movable blade to approach the fixed blade following and preceding the movable blade, and movable away from the fixed blade following and lagging behind the movable blade, wherein the movable cover covers the second cutting blade from the second cutting blade up to the second blade tip.

6. The chain-off thread cutter according to claim 5, further comprising:

a fixed cover configured to cover the first cutting blade from the first cutting blade up to the first blade tip.

* * * * *